US007417647B2

(12) United States Patent
Jeffrey

(10) Patent No.: US 7,417,647 B2
(45) Date of Patent: Aug. 26, 2008

(54) MAKING AN OVERLAY IMAGE EDGE ARTIFACT LESS CONSPICUOUS

(75) Inventor: Eric Jeffrey, Richmond (CA)

(73) Assignee: Seiko Epson Corporation, Tokyo (JP)

( * ) Notice: Subject to any disclaimer, the term of this patent is extended or adjusted under 35 U.S.C. 154(b) by 474 days.

(21) Appl. No.: 11/207,395

(22) Filed: Aug. 19, 2005

(65) Prior Publication Data

US 2007/0040849 A1 Feb. 22, 2007

(51) Int. Cl.
*G09G 5/00* (2006.01)
*G09G 5/02* (2006.01)

(52) U.S. Cl. ..... 345/634; 345/592

(58) Field of Classification Search ..... 345/592, 345/629–641

See application file for complete search history.

(56) References Cited

U.S. PATENT DOCUMENTS

RE37,668 E * 4/2002 Etoh ..... 382/251
7,145,573 B2 * 12/2006 Gottardo et al. ..... 345/589
2005/0093890 A1 * 5/2005 Baudisch ..... 345/639

* cited by examiner

*Primary Examiner*—Kee M. Tung
*Assistant Examiner*—Aaron M Richer
(74) *Attorney, Agent, or Firm*—Mark P. Watson

(57) ABSTRACT

The invention is directed, in preferred embodiments, to method and apparatus for storing overlay pixels of a scaled overlay image over background pixels of a background image. The overlay and background pixels being defined by at least a luminance component and a color component. A preferred method comprises: (a) defining a first luminance value corresponding to a transparent overlay pixel; (b) defining a second luminance value corresponding to an opaque overlay pixel; and (c) where, for any first overlay pixels for which luminance components differ from the first and second luminance values, storing the luminance components so as to over-write the luminance components of the corresponding background pixels, and discarding the associated color components so as to leave remaining the color components of the corresponding background pixels. Preferably, the overlay and background pixels are defined in a sampling format providing for color information to be shared between at least two pixels. Preferred embodiments do not require background image pixels previously stored in a memory to be read from the memory. In preferred embodiments, portions of edge artifacts are disguised and remaining portions are eliminated.

15 Claims, 12 Drawing Sheets

34 MEMORY

COLUMNS

| ROWS | 1 | 2 | 3 | 4 | 5 | 6 | 7 | 8 | 9 |
|---|---|---|---|---|---|---|---|---|---|
| 1 | $Y_{1,1}$ | $Y_{1,2}$ | $Y_{1,3}$ | $Y_{1,4}$ | $Y_{1,5}$ | $Y_{1,6}$ | $Y_{1,7}$ | $Y_{1,8}$ | |
| 2 | $Y_{2,1}$ | $Y_{2,2}$ | $Y_{2,3}$ | $Y_{2,4}$ | $Y_{2,5}$ | $Y_{2,6}$ | $Y_{2,7}$ | $Y_{2,8}$ | |
| 3 | $Y_{3,1}$ | $Y_{3,2}$ | $Y_{3,3}$ | $Y_{3,4}$ | $Y_{3,5}$ | $Y_{3,6}$ | $Y_{3,7}$ | $Y_{3,8}$ | |
| 4 | $Y_{4,1}$ | $Y_{4,2}$ | $Y_{4,3}$ | $Y_{4,4}$ | $Y_{4,5}$ | $Y_{4,6}$ | $Y_{4,7}$ | $Y_{4,8}$ | |
| 5 | $Y_{5,1}$ | $Y_{5,2}$ | $Y_{5,3}$ | $Y_{5,4}$ | $Y_{5,5}$ | $Y_{5,6}$ | $Y_{5,7}$ | $Y_{5,8}$ | |
| 6 | $Y_{6,1}$ | $Y_{6,2}$ | $Y_{6,3}$ | $Y_{6,4}$ | $Y_{6,5}$ | $Y_{6,6}$ | $Y_{6,7}$ | $Y_{6,8}$ | |
| 7 | $Y_{7,1}$ | $Y_{7,2}$ | $Y_{7,3}$ | $Y_{7,4}$ | $Y_{7,5}$ | $Y_{7,6}$ | $Y_{7,7}$ | $Y_{7,8}$ | |
| 8 | $Y_{8,1}$ | $Y_{8,2}$ | $Y_{8,3}$ | $Y_{8,4}$ | $Y_{8,5}$ | $Y_{8,6}$ | $Y_{8,7}$ | $Y_{8,8}$ | |
| 9 | | | | | | | | | |
| • | | | | | | | | | |
| • | | | | | | | | | |
| • | | | | | | | | | |
| 481 | $U_{1,1}$ | $V_{1,1}$ | $U_{1,2}$ | $V_{1,2}$ | $U_{1,3}$ | $V_{1,3}$ | $U_{1,4}$ | $V_{1,4}$ | |
| 482 | $U_{2,1}$ | $V_{2,1}$ | $U_{2,2}$ | $V_{2,2}$ | $U_{2,3}$ | $V_{2,3}$ | $U_{2,3}$ | $V_{2,4}$ | |
| 483 | $U_{3,1}$ | $V_{3,1}$ | $U_{3,2}$ | $V_{3\,2}$ | $U_{3,3}$ | $V_{3,3}$ | $U_{3,3}$ | $V_{3,4}$ | |
| 484 | $U_{4,1}$ | $V_{4,1}$ | $U_{4,2}$ | $V_{4,2}$ | $U_{4,3}$ | $V_{4,3}$ | $U_{4,3}$ | $V_{4\,4}$ | |
| | | | | | | | | | |

T1

T1

*FIG. 2c*

34 MEMORY

COLUMNS

| ROWS | 1 | 2 | 3 | 4 | 5 | 6 | 7 | 8 | 9 |
|---|---|---|---|---|---|---|---|---|---|
| | | T4 | | | | | | | |
| 1 | $Y_{1,1}$ | $Y_{1,2}$ | $Y_{1,3}$ | $Y_{1,4}$ | $Y_{1,5}$ | $Y_{1,6}$ | $Y_{1,7}$ | $Y_{1,8}$ | |
| 2 | $Y_{2,1}$ | $Y_{2,2}$ | $Y_{2,3}$ | $Y_{2,4}$ | $Y_{2,5}$ | $Y_{2,6}$ | $Y_{2,7}$ | $Y_{2,8}$ | |
| 3 | $Y_{3,1}$ | $Y_{3,2}$ | $\mathbf{Y'_{3,3}}$ | $\mathbf{Y'_{3,4}}$ | $Y_{3,5}$ | $Y_{3,6}$ | $Y_{3,7}$ | $Y_{3,8}$ | |
| 4 | $Y_{4,1}$ | $Y_{4,2}$ | $\mathbf{Y'_{4,3}}$ | $\mathbf{Y'_{4,4}}$ | $Y_{4,5}$ | $Y_{4,6}$ | $Y_{4,7}$ | $Y_{4,8}$ | |
| 5 | $Y_{5,1}$ | $Y_{5,2}$ | $Y_{5,3}$ | $Y_{5,4}$ | $Y_{5,5}$ | $Y_{5,6}$ | $Y_{5,7}$ | $Y_{5,8}$ | |
| 6 | $Y_{6,1}$ | $Y_{6,2}$ | $Y_{6,3}$ | $Y_{6,4}$ | $Y_{6,5}$ | $Y_{6,6}$ | $Y_{6,7}$ | $Y_{6,8}$ | |
| 7 | $Y_{7,1}$ | $Y_{7,2}$ | $Y_{7,3}$ | $Y_{7,4}$ | $Y_{7,5}$ | $Y_{7,6}$ | $Y_{7,7}$ | $Y_{7,8}$ | |
| 8 | $Y_{8,1}$ | $Y_{8,2}$ | $Y_{8,3}$ | $Y_{8,4}$ | $Y_{8,5}$ | $Y_{8,6}$ | $Y_{8,7}$ | $Y_{8,8}$ | |
| 9 | | | | | | | | | |
| • | | | | | | | | | |
| • | | | | | | | | | |
| • | | T4 | | | | | | | |
| 481 | $U_{1,1}$ | $V_{1,1}$ | $U_{1,2}$ | $V_{1,2}$ | $U_{1,3}$ | $V_{1,3}$ | $U_{1,4}$ | $V_{1,4}$ | |
| 482 | $U_{2,1}$ | $V_{2,1}$ | $\mathbf{U'_{2,2}}$ | $\mathbf{V'_{2,2}}$ | $U_{2,3}$ | $V_{2,3}$ | $U_{2,3}$ | $V_{2,4}$ | |
| 483 | $U_{3,1}$ | $V_{3,1}$ | $U_{3,2}$ | $V_{3\,2}$ | $U_{3,3}$ | $V_{3,3}$ | $U_{3,3}$ | $V_{3,4}$ | |
| 484 | $U_{4,1}$ | $V_{4,1}$ | $U_{4,2}$ | $V_{4,2}$ | $U_{4,3}$ | $V_{4,3}$ | $U_{4,3}$ | $V_{4\,4}$ | |
| | | | | | | | | | |

*FIG. 2d*

OVERLAY WINDOW 28 26 BACKGROUND IMAGE

| | | | | | | | |
|---|---|---|---|---|---|---|---|
| $P_{1,1}$ | $P_{1,2}$ | $P_{1,3}$ | $P_{1,4}$ | $P_{1,5}$ | $P_{1,6}$ | $P_{1,7}$ | $P_{1,8}$ |
| $P_{2,1}$ | $P_{2,2}$ | $P_{2,3}$ | $P_{2,4}$ | $P_{2,5}$ | $P_{2,6}$ | $P_{2,7}$ | $P_{2,8}$ |
| $P_{3,1}$ | $P_{3,2}$ | $P'_{3,3}$ | $P'_{3,4}$ | $P_{3,5}$ | $P_{3,6}$ | $P_{3,7}$ | $P_{3,8}$ |
| $P_{4,1}$ | $P_{4,2}$ | $P'_{4,3}$ | $P'_{4,4}$ | $P_{4,5}$ | $P_{4,6}$ | $P_{4,7}$ | $P_{4,8}$ |
| $P_{5,1}$ | $P_{5,2}$ | $P_{5,3}$ | $P_{5,4}$ | $P_{5,5}$ | $P_{5,6}$ | $P_{5,7}$ | $P_{5,8}$ |
| $P_{6,1}$ | $P_{6,2}$ | $P_{6,3}$ | $P_{6,4}$ | $P_{6,5}$ | $P_{6,6}$ | $P_{6,7}$ | $P_{6,8}$ |
| $P_{7,1}$ | $P_{7,2}$ | $P_{7,3}$ | $P_{7,4}$ | $P_{7,5}$ | $P_{7,6}$ | $P_{7,7}$ | $P_{7,8}$ |
| $P_{8,1}$ | $P_{8,2}$ | $P_{8,3}$ | $P_{8,4}$ | $P_{8,5}$ | $P_{8,6}$ | $P_{8,7}$ | $P_{8,8}$ |

*FIG. 2e*

42 OVERLAY WINDOW

| | | | | | | | |
|---|---|---|---|---|---|---|---|
| $P'_{1,1}$ | $P'_{1,2}$ | $P'_{1,3}$ | $P'_{1,4}$ | $P'_{1,5}$ | $P'_{1,6}$ | $P'_{1,7}$ | $P'_{1,8}$ |
| $P'_{2,1}$ | $P'_{2,2}$ | $P'_{2,3}$ | $P'_{2,4}$ | $P'_{2,5}$ | $P'_{2,6}$ | $P'_{2,7}$ | $P'_{2,8}$ |
| $P'_{3,1}$ | $P'_{3,2}$ | $P'_{3,3}$ | $P'_{3,4}$ | $P'_{3,5}$ | $P'_{3,6}$ | $P'_{3,7}$ | $P'_{3,8}$ |
| $P'_{4,1}$ | $P'_{4,2}$ | $P'_{4,3}$ | $P'_{4,4}$ | $P'_{4,5}$ | $P'_{4,6}$ | $P'_{4,7}$ | $P'_{4,8}$ |
| $P'_{5,1}$ | $P'_{5,2}$ | $P'_{5,3}$ | $P'_{5,4}$ | $P'_{5,5}$ | $P'_{5,6}$ | $P'_{5,7}$ | $P'_{5,8}$ |
| $P'_{6,1}$ | $P'_{6,2}$ | $P'_{6,3}$ | $P'_{6,4}$ | $P'_{6,5}$ | $P'_{6,6}$ | $P'_{6,7}$ | $P'_{6,8}$ |
| $P'_{7,1}$ | $P'_{7,2}$ | $P'_{7,3}$ | $P'_{7,4}$ | $P'_{7,5}$ | $P'_{7,6}$ | $P'_{7,7}$ | $P'_{7,8}$ |
| $P'_{8,1}$ | $P'_{8,2}$ | $P'_{8,3}$ | $P'_{8,4}$ | $P'_{8,5}$ | $P'_{8,6}$ | $P'_{8,7}$ | $P'_{8,8}$ |

30

32

*FIG. 3a*

MAKING AN OVERLAY IMAGE EDGE ARTIFACT LESS CONSPICUOUS

FIELD OF THE INVENTION

The present invention relates generally to making artifacts less conspicuous in graphics display systems, and more particularly to methods and apparatus for making an edge artifact associated with an overlay image less conspicuous.

BACKGROUND

Mobile devices commonly have graphics display systems that include a host, a camera, and a display device. They also include a graphics controller for driving the display device and interfacing the host, camera, and display device to one another. The host may be a CPU or a digital signal processor. The graphics controller commonly includes an embedded memory for storing image data. A mobile device may be, for example, a mobile telephone, personal digital assistant, digital camera, or a digital music player. Mobile devices typically rely primarily on a battery for power. To maximize battery life in these devices, it is important to minimize power consumption. It is also important to minimize the size of the memory which reduces cost and also reduces power consumption.

The graphics display systems in mobile devices employ a variety of techniques for minimizing power consumption and memory size. Many of these techniques are not employed in larger, stationary systems, such as personal computers which generally have more memory, faster processors, and less critical power constraints. Use of some of these power saving techniques in mobile devices may result in a modest reduction in image fidelity, which is acceptable because the reduction is not readily noticeable by the human eye. Sometimes, however, these techniques may create artifacts on the display screen that are quite noticeable and therefore undesirable.

One noticeably artifact is a gray fringe that sometimes appears around the periphery of dark text that has been overlaid on a background image, such as a photograph. Accordingly, methods and apparatus for making an edge artifact associated with an overlay image less conspicuous would be desirable.

SUMMARY

Preferred embodiments includes methods and apparatus for making an edge artifact associated with an overlay image less conspicuous. Preferred embodiments do not require background image pixels previously stored in a memory to be read from the memory. In preferred embodiments, portions of edge artifacts are disguised and remaining portions are eliminated.

The invention is directed, in one preferred embodiment, to a method for storing overlay pixels of a scaled overlay image over background pixels of a background image. The overlay and background pixels being defined by at least a luminance component and a color component. A preferred method comprises: (a) defining a first luminance value corresponding to a transparent overlay pixel; (b) defining a second luminance value corresponding to an opaque overlay pixel; and (c) where, for any first overlay pixels for which luminance components differ from the first and second luminance values, storing the luminance components so as to over-write the luminance components of the corresponding background pixels, and discarding the associated color components so as to leave remaining the color components of the corresponding background pixels. Preferably, the overlay and background pixels are defined in a sampling format providing for color information to be shared between at least two pixels. In addition, a preferred method preferably includes receiving the overlay pixels for storing the luminance components and discarding the associated color components of any the first overlay pixels for which luminance components differ from the first and second luminance values.

Another preferred embodiment is directed to a graphics controller for storing overlay pixels of a scaled overlay image over background pixels of a background image. The overlay and background pixels are defined by at least a luminance component and a color component. A preferred graphics controller comprises: (a) a memory; and (a) an artifact disguising and eliminating unit including: (i) a comparing device for comparing luminance components of the overlay pixels with a first luminance value corresponding to a transparent overlay pixel and a second luminance value corresponding to an opaque overlay pixel, and (ii) a selecting device adapted for, for any first overlay pixels for which luminance components differ from the first and second luminance values, storing the luminance components in the memory so as to over-write the luminance components of the corresponding background pixels, and discarding the associated color components so as to leave remaining in the memory the color components of the corresponding background pixels. Preferably, the overlay and background pixels are defined in a sampling format providing for color information to be shared between at least two pixels. In addition, a preferred graphics controller includes an interface unit for receiving the overlay pixels.

A preferred embodiment is directed to a graphics display system for storing overlay pixels of a scaled overlay image over background pixels of a background image. The overlay and background pixels are defined by at least a luminance component and a color component. A preferred graphics display system comprises: (a) a display device; (b) at least one image data source; (c) a single frame buffer memory; and (d) an artifact disguising and eliminating unit including: (i) a comparing device for comparing luminance components of the overlay pixels with a first luminance value corresponding to a transparent overlay pixel and a second luminance value corresponding to an opaque overlay pixel, and (ii) a selecting device adapted for, for any first overlay pixels for which luminance components differ from the first and second luminance values, storing the luminance components in the memory so as to over-write the luminance components of the corresponding background pixels, and discarding the associated color components so as to leave remaining in the memory the color components of the corresponding background pixels. Preferably, the overlay and background pixels are defined in a sampling format providing for color information to be shared between at least two pixels. In addition, a preferred graphics controller includes an interface unit for receiving the overlay pixels.

Another preferred embodiment is directed to a machine readable medium that embodies a program of instructions that may be executed by a machine for performing a method for storing overlay pixels of a scaled overlay image over background pixels of a background image. The overlay and background pixels being defined by at least a luminance component and a color component. With respect to preferred medium, a preferred method comprises: (a) defining a first luminance value corresponding to a transparent overlay pixel; (b) defining a second luminance value corresponding to an opaque overlay pixel; and (c) where, for any first overlay pixels for which luminance components differ from the first and second luminance values, storing the luminance components so as to over-write the luminance components of the corresponding background pixels, and discarding the associated color components so as to leave remaining the color components of the corresponding background pixels. Preferably, the overlay and background pixels are defined in a sampling format providing for color information to be shared between at least two pixels. In addition, with respect to preferred medium, a preferred method preferably includes receiving the overlay pixels for storing the luminance components and discarding the associated color components of any the first overlay pixels for which luminance components differ from the first and second luminance values.

The objectives, features, and advantages of the invention will be more readily understood upon consideration of the following detailed description of the invention, taken in conjunction with the accompanying drawings.

BRIEF DESCRIPTION OF THE DRAWINGS

FIG. 2*c* illustrates a memory with the background image of FIG. 2*a* stored therein.

FIG. 2*d* illustrates the memory of FIG. 2*c* after the overlay window of FIG. 2*b* has been stored therein.

FIG. 2*e* illustrates an image rendered according to the image data stored in the memory of FIG. 2*d*.

FIG. 3*a* an exemplary overlay window that includes opaque and transparent pixels.

DETAILED DESCRIPTION OF PREFERRED EMBODIMENTS

Figure 1:
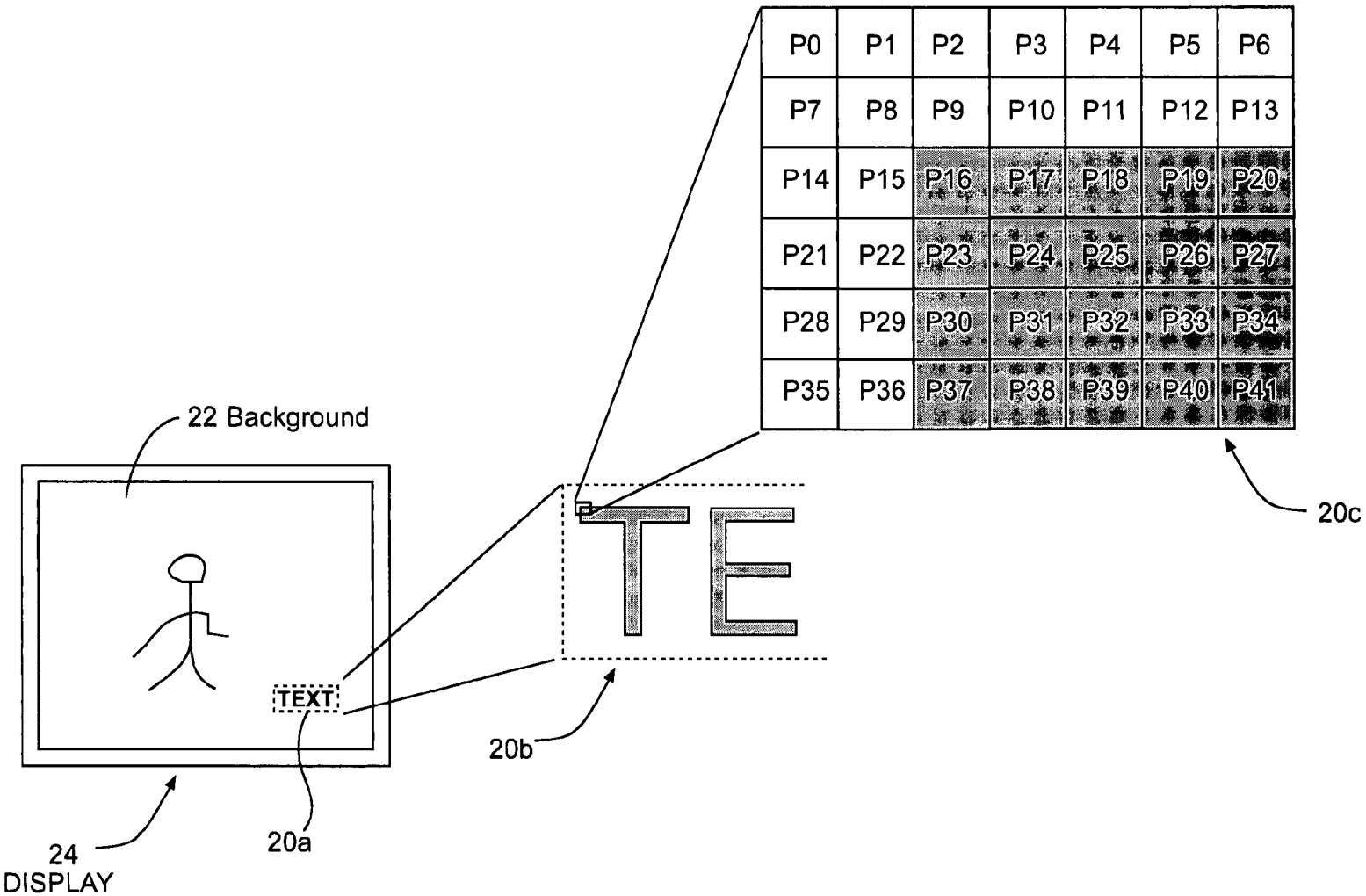
FIG. 1 illustrates an exemplary overlay window.

The invention is directed to methods and apparatus for making an edge artifact associated with an overlay image less conspicuous. Reference will now be made in detail to the present preferred embodiments of the invention, examples of which are illustrated in the accompanying drawings. Wherever possible, the same reference numbers are used in the drawings and the description to refer to the same or like parts.

The image on a display screen is formed from an array of small discrete elements ("pixels.") The attributes of each pixel, such as its brightness and color, are represented by a numeric value, which is typically represented in binary form. Thus, an image can also be considered as an array of binary elements of data. For convenience of explanation and in accordance with the use of the term in the art, the term pixel is used herein to refer at times to the display elements of a display device, at times to the binary elements of data that are stored and manipulated within a graphics display system and which define the attributes of such display elements, and at times to both, the appropriate sense of the term being clear from the context.

Pixels may be defined in more than one color model (a mathematical model for describing a gamut of colors). Color display devices generally require that pixels be defined by the RGB color model. However, other color models, such as the YUV model can be more efficient than the RGB model for processing image data. In the RGB model, a pixel is defined by a red, green, and blue component. In the YUV model, a pixel is defined by a brightness component (Y), and two color components (U, V).

The YUV model permits the use of a lower resolution for the color information in an image. The human eye is more sensitive to brightness than to color so the use of lower color resolution can conserve processing resources with little visual impact. A lower color resolution may be obtained by means of chroma subsampling, in which a sampling format defines how groups of consecutive YUV pixels are sampled. Particular sampling formats include 4:4:4, 4:2:2, 4:2:0, and 4:1:1. In the 4:4:4 sampling format, each pixel has a Y, U, and V sample. In the 4:2:2 sampling format, for each two horizontal pixels, there are two Y samples, one U sample, and one V sample. In the 4:1:1 sampling format, for every four horizontal pixels, there are four Y samples, one U sample, and one V sample. The 4:2:0 sampling format implements a 2:1 reduction of U and V in both the horizontal and vertical directions. In the 4:2:0 sampling format, for each of four pixels consisting of two horizontal pixels in two rows, there are four Y samples, one U sample, and one V sample. The phrase "chroma subsampling," as used herein, includes the most common sampling formats (4:4:4, 4:2:2, 4:2:0, and 4:1:1), but is also intended to refer to other sampling formats not specifically mentioned, such as those that provide for color resolution which is lower than is provided by 4:2:0, and 4:1:1. Further, while preferred embodiments of the invention relate to YUV image data, it should be understood that other embodiments are directed to chroma subsampling image data defined in other color models, e.g., the YCrCb color model.

Storing an image with lower color resolution, e.g., in the 4:2:2, 4:2:0, and 4:1:1 sampling formats requires less memory than storing the same image in RGB or YUV 4:4:4 format. For example, assuming each component is 8 bits, storing 4 pixels in a 4:4:4 format requires 96 bits, whereas storing 4 pixels in a 4:2:0 format requires only 48 bits. Accordingly, graphics display systems in mobile devices may convert an image to YUV and chroma subsample the image before storing to reduce memory requirements. Before the image is displayed, the missing U and V values may be repeated or interpolated to create YUV data in the 4:4:4 format which is then converted to RGB.

Pixels in a display device are generally updated or "refreshed" according to a raster scan pattern, that is, from side to side in lines from top to bottom. In addition, pixels are commonly stored in memory, fetched from memory, and written to the display device in raster order.

An array of pixels may be referred to as a "frame." It is common to render several images simultaneously on a display screen. For instance, a frame defining a main image may be rendered on the display screen with one or more overlay images ("windows") rendered on top of the main image. The main image appears as a background image and the overlay window appears as a foreground image. Herein, the term "background image" is used interchangeably with the term "main image," and the terms "foreground image" and "overlay window" are used interchangeably with the term "overlay image." The main image may be a photographic image, for example, while the overlay image may be text or symbols. The host, the camera, some other image data source, or a combination of sources may provide the image data defining the main and overlay images.

To keep the size of the memory to a minimum in graphics display systems in mobile devices, it is preferable to store the main and overlay images for a display frame in a single display buffer memory. After the main image frame is stored, the overlay image is stored. The overlay image is stored in a "destructive" write operation. That is, the main image pixels that "lie underneath" the pixels of an overlay image are destroyed when they are replaced with overlay image pixels in a write operation.

It is typically more efficient for a host or other source to provide a rectangular frame than an irregularly shaped frame. Accordingly, an overlay image of text or symbols is commonly provided as a rectangular overlay window rather than an irregularly shaped frame that follows the contours of the characters or symbols. In systems where the main and overlay images are stored in a single frame buffer, these rectangular overlay windows typically include two types of pixels: "opaque" and "transparent." The pixels which form the letters or symbols are opaque. Typically, they are black, or a dark color. The pixels which fill in the portions of the rectangular sub-frame not occupied by text or symbol are transparent. For example, opaque pixels have the value: Y=0, U=128, and V=128, and transparent pixels have the value: Y=255, U=128, and V=128.

FIG. 1 shows an exemplary overlay window 20 in three perspectives. The overlay window 20*a* is shown superimposed on an exemplary background image 22 displayed on a display device 24 in the lower right corner of the figure. The dashed line overlay window 20 surrounding the word "TEXT" is shown only for the purpose of defining the borders of the overlay window in the illustration. On an actual display screen, the word text would appear superimposed on the background image 22 and the dashed line would not be visible. An enlarged portion of the overlay window 20 is shown in FIG. 1 as overlay window 20*b*. Zooming further in, a further enlarged portion of the overlay window 20 is shown as overlay window 20*c*, in which a block of pixels P0-P41 can be seen. This block of pixels includes the upper left corner of the letter "T." In the zoomed-in portion 20*c*, the shaded pixels represent part of the letter T, and the un-shaded pixels represent the area immediately outside the letter. The un-shaded pixels are part of the rectangular overlay window. When the image is rendered on the display device, background image pixels are displayed where the un-shaded pixels are shown. For example, in the location where the pixel P0 is shown, a pixel of the background image would be rendered. As further explained below, the shaded pixels of the overlay image are "opaque," and the un-shaded pixels are "transparent."

To achieve the appearance of text appearing superimposed on a background image, a "first" method has been employed when storing an overlay window having "opaque" and "transparent" pixels in a single display buffer. A background image is stored in the display buffer, preferably in raster order. An overlay window is then stored, also preferably in raster order, into the single display buffer memory. The overlay window, typically being smaller than the background window, is stored at a particular location in the memory, which corresponds to the portion of the background image that it will overlay when rendered on the display screen. This location may be defined, for example, by the row and column coordinates of a selected background pixel. For instance, the upper left corner of the overlay window may be mapped to the coordinates of the selected background pixel. According to the first method, as the overlay window is written to memory, the luminance value of each overlay pixel is examined. If a pixel does not have a particular, predefined luminance value (e.g., Y=255), it is considered "opaque." If a pixel does have the predefined luminance value, it is considered to be "transparent." Opaque pixels are stored in the memory. When an opaque pixel is stored, the background image pixel corresponding to the particular raster-ordered location is overwritten. Transparent pixels are discarded. When a transparent pixel is discarded, the background image pixel at that raster-ordered location is preserved.

Figure 2A:
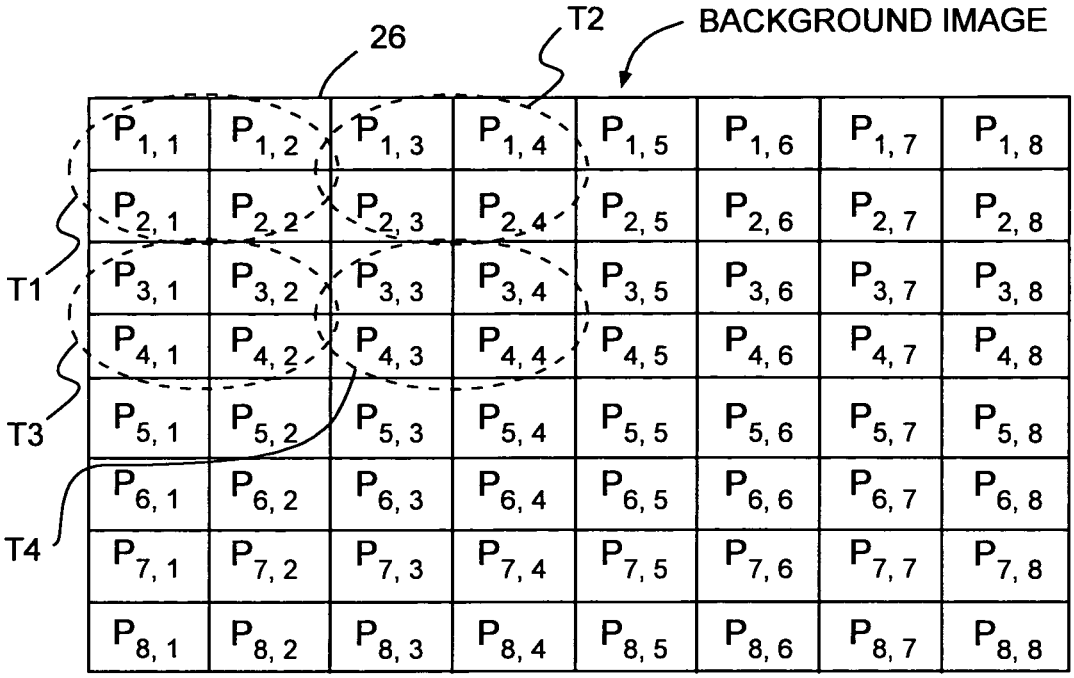
FIG. 2*a* illustrates an exemplary background image.
Figure 2B:
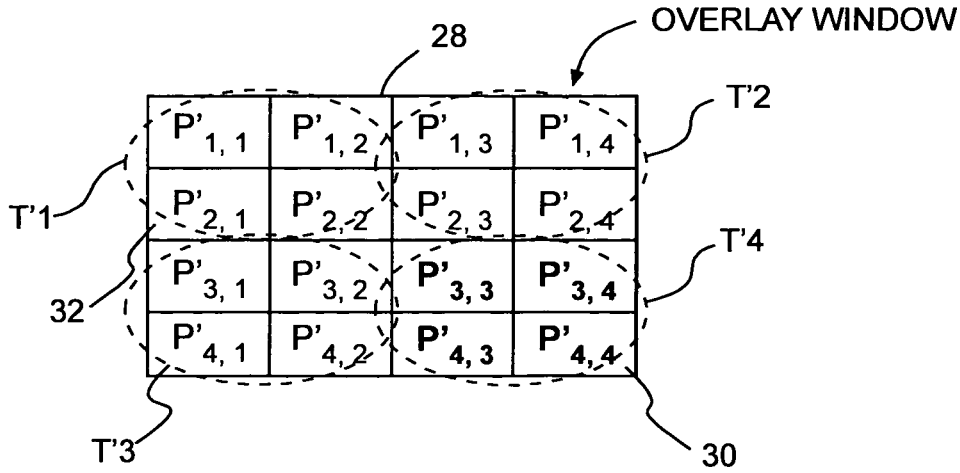
FIG. 2*b* illustrates an exemplary overlay window.

FIGS. 2*a*, 2*b* illustrate another exemplary background image 26 and overlay window 28. The background image 26 includes 64 pixels $P_{1,1}$ to $P_{8,8}$, where the subscripts designate the row and column of the pixel in the image. Similarly, the overlay window 28 includes 16 pixels $P'_{1,1}$ to $P'_{4,4}$. In the overlay window 28, the pixels 30 ($P'_{3,3}$, $P'_{3,4}$, $P'_{4,3}$, $P'_{4,4}$) are opaque and the remaining pixels 32 are transparent. The opaque pixels are shown in bold.

In FIG. 2*a*, four pixel "tiles," T1, T2, T3, and T4 are highlighted, and in FIG. 2*b*, four pixel tiles, T'1, T'2, T'3, and T'4, are highlighted. A 2×2 block of pixels may be referred to herein as a pixel "tile." The pixel tiles referred to in the examples herein are defined in the YUV color model and the 4:2:0 sampling format. Each pixel in a tile is defined by a unique luminance component and a common pair of U and V components. It will be appreciated that the term "pixel tile" may be generalized to refer to other sampling formats. Accordingly, the use of the term "pixel tile" is not intended to limit the scope of the invention to the 4:2:0 sampling format.

FIG. 2*c* illustrates the background image 26 (shown in FIG. 2*a*) as it may be stored in a memory 34. The pixels of the background image 26 are defined in terms of the YUV color model and the 4:2:0 sampling format. The subscripts of the Y components (luminance) designate the row and column of the pixel in the image 26, and the subscripts of the U and V components (color) designate the row and column of the tile. For instance, pixel $P_{1,1}=(Y_{1,1}, U_{1,1}, V_{1,1})$, $P_{1,2}=(Y_{1,2}, U_{1,1}, V_{1,1})$, $P_{2,1}=(Y_{2,1}, U_{1,1}, V_{1,1})$, and $P_{2,2}=(Y_{2,2}, U_{1,1}, V_{1,1})$. The pixel tile T1 is highlighted.

FIG. 2*d* shows the memory 34 of FIG. 2*c* after the overlay window 28 (FIG. 2*b*) has been stored in the memory. In FIG. 2*d*, the overlay window is stored in the memory at locations which map or "correspond" to the upper left portion of the background image. Referring again to FIG. 2*b*, the pixels $P'_{3,3}$, $P'_{3,4}$, $P'_{4,3}$, and $P'_{4,4}$ are opaque and the remaining overlay pixels are transparent. Accordingly, $Y_{3,3}$, $Y_{3,4}$, $Y_{4,3}$, and $Y_{4,4}$ of the image 26 are overwritten with $Y'_{3,3}$, $Y'_{3,4}$, $Y'_{4,3}$, and $Y'_{4,4}$ of the overlay window. Similarly, $U_{2,2}$, and $V_{2,2}$ are overwritten with $U'_{2,2}$ and $V'_{2,2}$. The overwritten components are shown in bold. The overwritten components correspond to the pixel tile T4, which is highlighted.

FIG. 2*e* shows the overlay window 28 and background image 26 that would be rendered on a display device according to the image data stored in the memory 34 shown in FIG. 2*d*.

When an overlay image defined by a rectangular sub-frame of opaque and transparent pixels is stored over a background image, an edge artifact may or may not appear in the displayed image. When the edge artifact appears, it often appears as a gray fringe around the periphery of dark text. If the edge artifact does not appear, it may be because (a) the pixel tiles of the overlay window contain either all opaque or all transparent pixels, and (b) the pixel tiles of the overlay window are aligned with the pixel tiles of the background image. With regard to the example presented in FIGS. 2*a-e*, an edge artifact would not appear in the displayed image, because (a) in the overlay window 28, the pixel tiles T'1, T'2, and T'3 contain only transparent pixels, and the pixel tile T'4 contains only opaque pixels, and (b) the pixel tiles T'1, T'2, T'3 and T'4 of the overlay window are aligned with the pixel tiles T1, T2, T3 and T4 of the background image. However, if these two conditions are not satisfied, an edge artifact may appear in the displayed image.

One context where these conditions may not be met and an edge artifact occurs is when an overlay window is scaled from its original size. Typically, the scaled overlay window is written to a single frame buffer memory containing a background image. In addition, the display frame pixel data and the scaled overlay image are typically defined in a YUV format with reduced color resolution, though an edge artifact may also occur where the image data is in other color formats or where there is no reduction in color resolution. An artifact may occur where the overlay window is either down-scaled or up-scaled. In particular, when an overlay window is scaled, the tiles of the overlay window may not be properly aligned with the tiles of the background image, the overlay tiles may contain blended pixels that are neither opaque or transparent, or the overlay tiles may contain pixels of one more than one type.

Figure 3B:
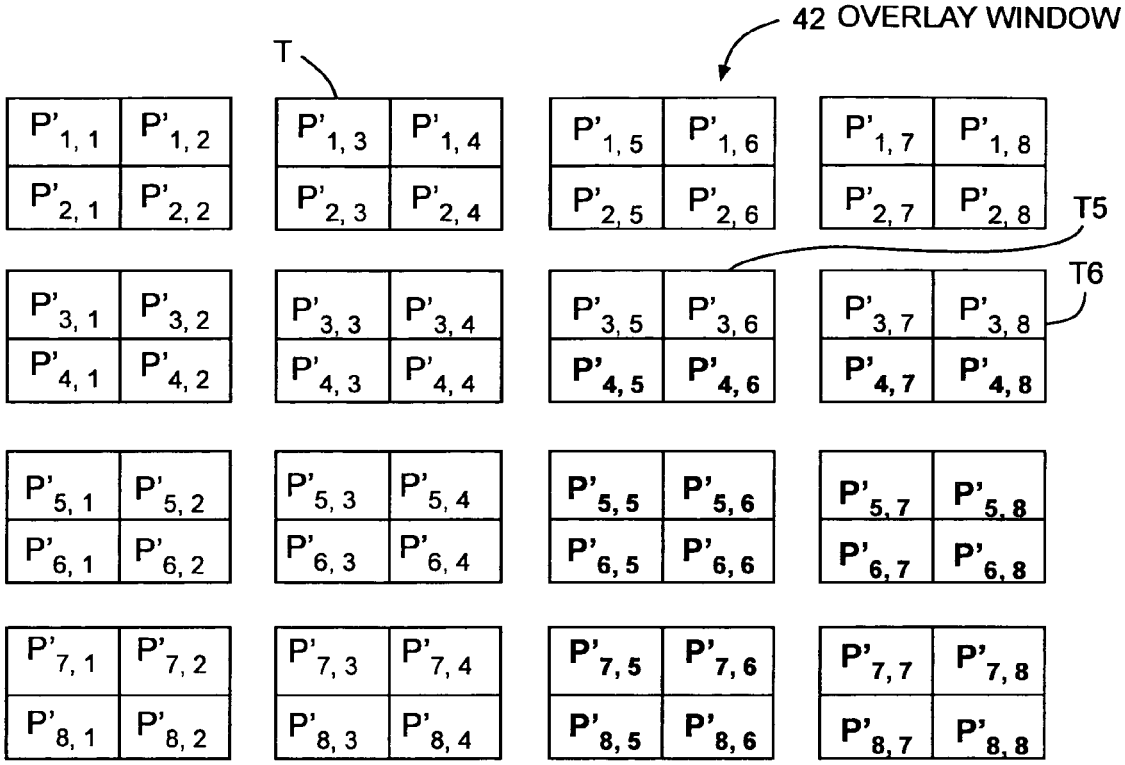
FIG. 3*b* is a first alternative view of the overlay window of FIG. 3*a*.

FIGS. 3*a-k* illustrate one circumstance in which an edge artifact appears in the displayed image. FIG. 3*a* shows an exemplary overlay window 42 that includes opaque and transparent pixels 30, 32. As before, the opaque pixels 30 are shown in bold.

FIG. 3*b* shows a first alternative view of the overlay window 42. In this view the overlay window 42 is separated into pixel tiles T. Two of the overlay window tiles do not exclusively contain pixels of one type. The pixel tiles T5 and T6 include both opaque and transparent pixels.

Figure 3C:
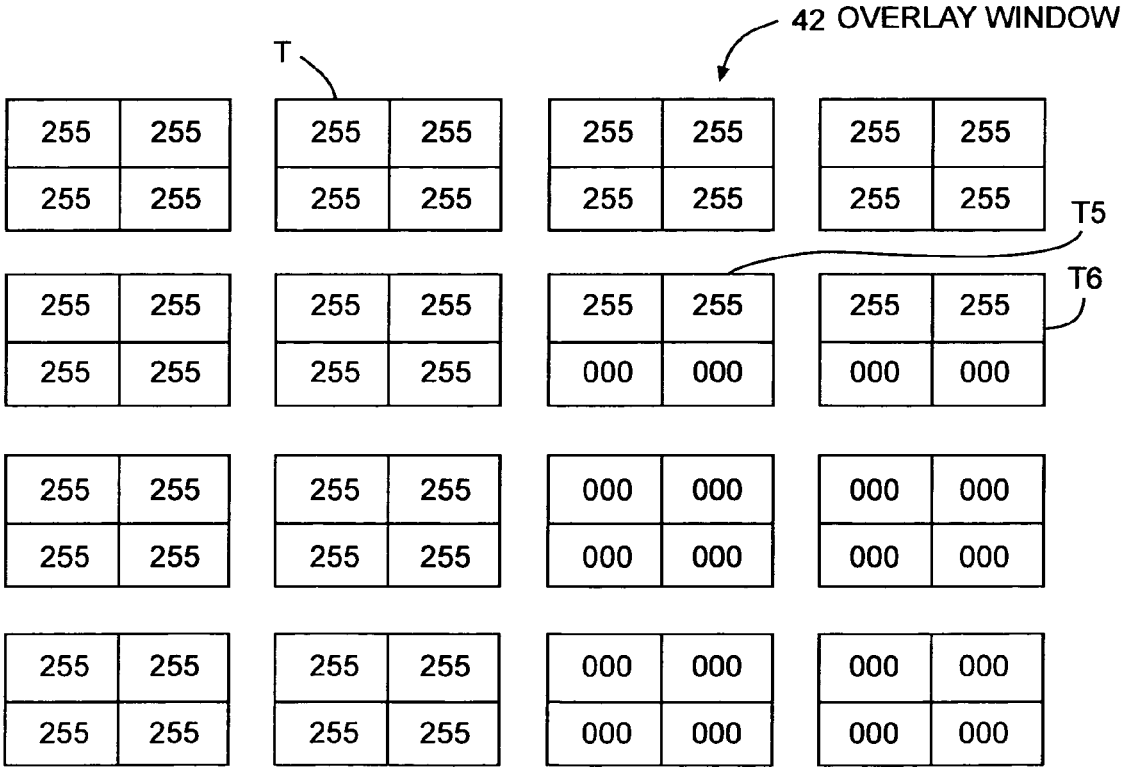
FIG. 3*c* is a second alternative view of the overlay window of FIG. 3*a*.

FIG. 3*c* shows a second alternative view of the overlay window 42. In this view the overlay window 42 is again separated into pixel tiles T, and exemplary Y values (luminance components) of the pixels appear at each pixel location. For example, the Y value of pixel $P'_{3,5}$ is 000.

Figure 3D:
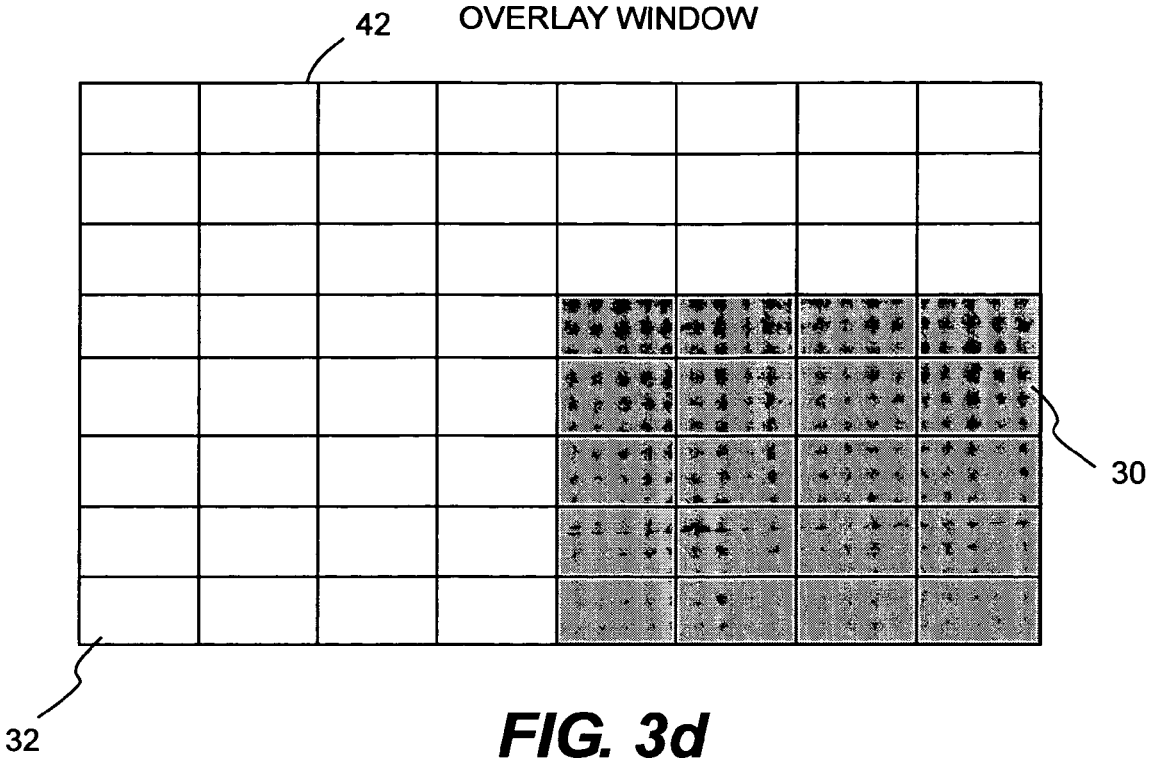
FIG. 3*d* is a third alternative view of the overlay window of FIG. 3*a*.

FIG. 3*d* shows a third alternative view of the overlay window 42. In this view the opaque pixels 30 are shaded, and the transparent pixels 32 are not shaded. Preferably, the opaque pixels of an overlay window represent a letter, a symbol, or some other graphic. Comparing the overlay window 42 of FIG. 3*d* with the overlay window 20 of FIG. 1, it can be seen that the opaque pixels 30 of overlay image may represent a portion of a letter, symbol, or graphic.

Figure 3H:
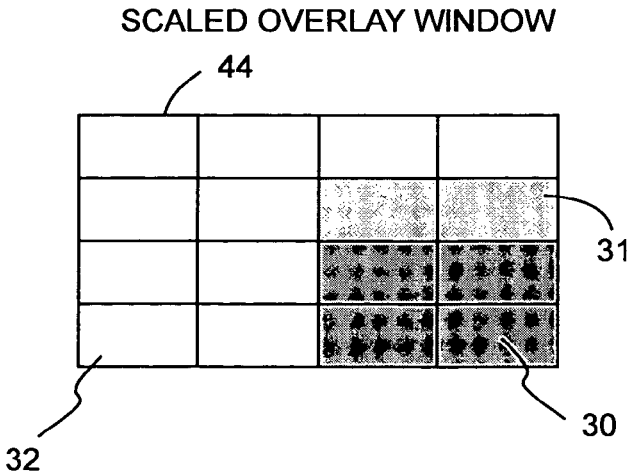
FIG. 3*h* illustrates a third alternative view of the overlay window of FIG. 3*e*.
Figure 3E:
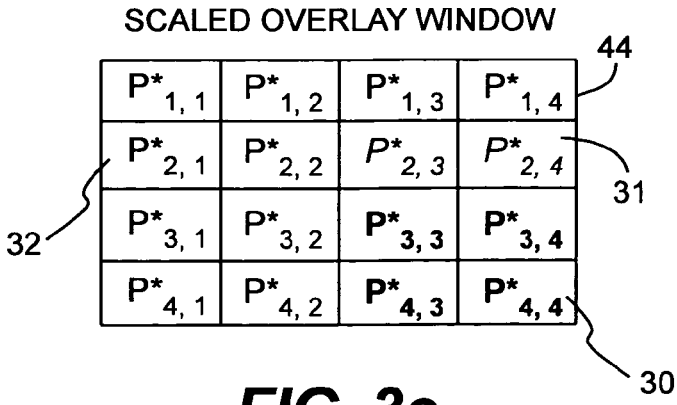
FIG. 3*e* illustrates an exemplary overlay window created by down-scaling the overlay window of FIG. 3*a*.

FIG. 3*e* shows another overlay window 44. The overlay window 44 is created by down-scaling the overlay window 42. In the scaled overlay window 44, the pixels 30 are opaque and shown in bold. Transparent pixels 32 are shown in plain text. In addition, pixels 31 that are neither opaque or transparent ("blended"), i.e., $P^*_{2,3}$ and $P^*_{2,4}$, are shown in italics. The blended pixels are created by the scaling process, which often involves interpolation of the original pixels.

Figure 3F:
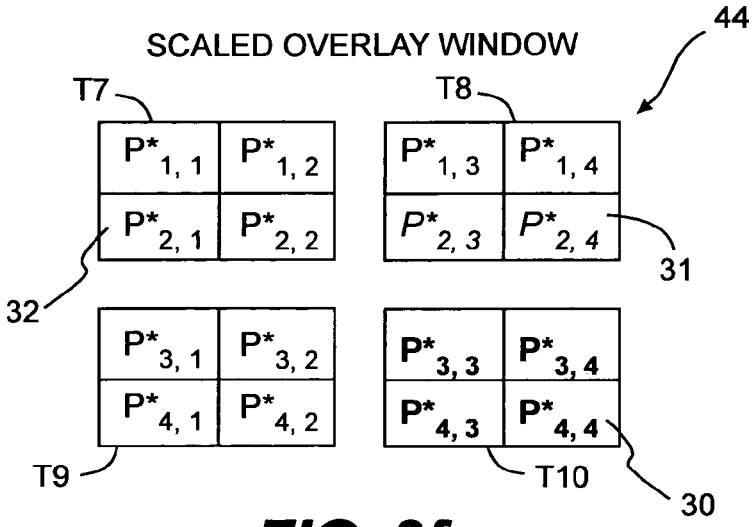
FIG. 3*f* illustrates a first alternative view of the overlay window of FIG. 3*e*.

FIG. 3*f* shows a first alternative view of the scaled overlay window 44. In this view the scaled overlay window 44 is separated into pixel tiles T7, T8, T9, and T10.

Figure 3G:
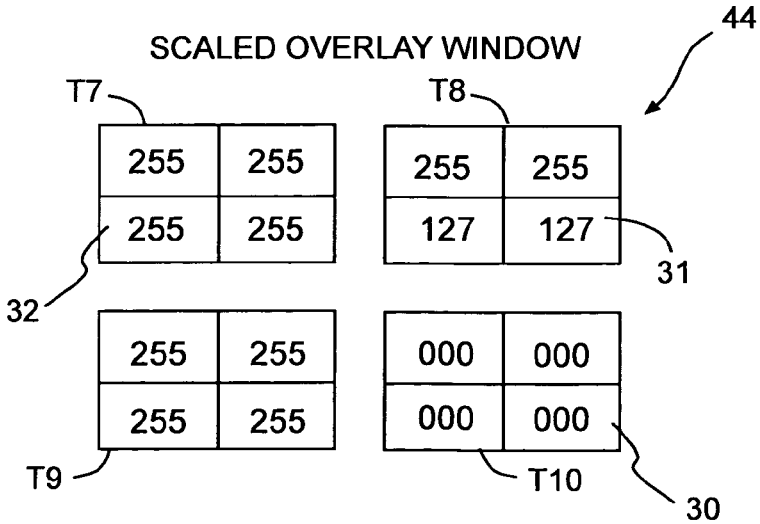
FIG. 3*g* illustrates a second alternative view of the overlay window of FIG. 3*e*.

FIG. 3*g* shows a second alternative view of the scaled overlay window 44. In this view the overlay window 42 is again separated into pixel tiles, and the Y value (luminance components) of the pixels appears at each pixel location. The values shown for the blended pixels 31 in FIG. 3*g* result from the scaling process. In an exemplary scaling process, the pixel component values of a 2×2 tile are averaged to produce a scaled value. An equation for producing a scaled luminance value of a pixel $P^*_{1,1}$ is given by:

$$Y^*_{1,1}=(Y_{1,1}+Y_{1,2}+Y_{2,1}+Y_{2,2})/4$$

The equation assumes YUV 4:2:0 image data, where four pixels in an original image pixel tile are denoted: $P_{1,1}$, $P_{1,2}$, $P_{2,1}$, $P_{2,2}$, and the pixel in the scaled image is denoted $P^*_{1,1}$. The U and V components are scaled in an analogous manner. While this equation may be used in one preferred embodiment, it is also presented for purposes of illustration. It will be appreciated by one skilled in the art that many other equations may be used for scaling an image.

Referring to FIG. 3*g*, it can be seen that the scaled pixel $P^*_{1,1}$ is transparent (Y=255), and the scaled pixel $P^*_{3,3}$ is opaque (Y=000). However, the scaled pixel $P^*_{2,3}$ is a blend of opaque and transparent luminance values (Y=127.5, which may be rounded or truncated to 127).

FIG. 3*h* shows a third alternative view of the scaled overlay window 44. In this view the opaque pixels 30 are shown in a dark shade, the transparent pixels 32 are not shaded, and the blended pixels 31 are shown lightly shaded. When the overlay window 44 is rendered on a display device, the blended pixels 31 appear as a gray fringe around the periphery of darker pixels 30, which may be text or symbols. The blended pixels 31 create a scaling artifact, which is often readily noticeable.

Figure 3I:
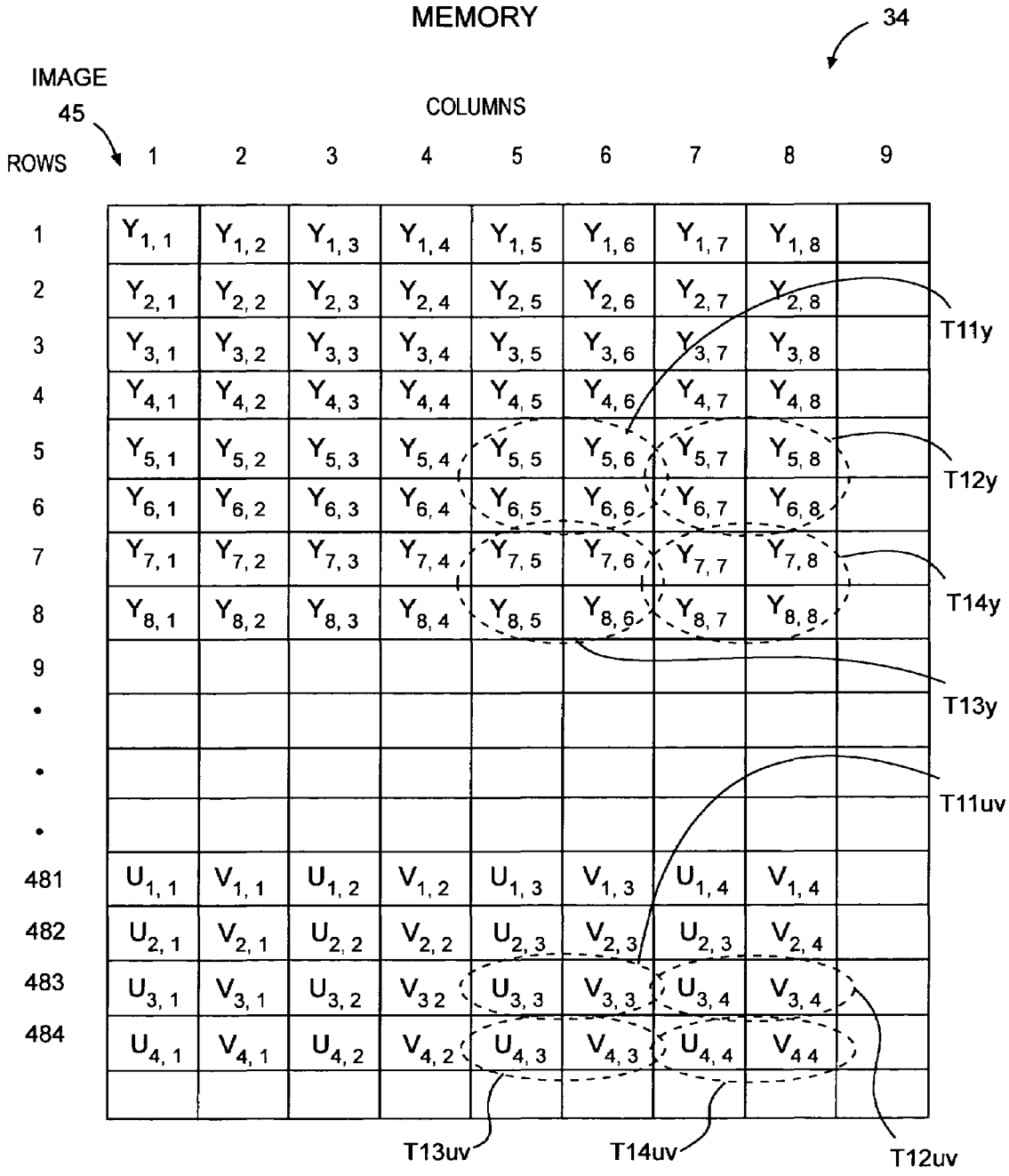
FIG. 3*i* illustrates a memory with a background image stored therein.

FIG. 3*i* shows the memory 34 with an exemplary background image 45 stored therein. The pixels of the background image 45 are defined in terms of the YUV color model and the 4:2:0 sampling format. In FIG. 3*i*, the respective components of four pixel tiles T11, T12, T13, and T14 of the background image 45 are designated by circular dashed lines. The Y components of tiles 11, 12, 13, and 14 are designated in FIG. 3*i* by reference numbers T11*y*, T12*y*, T13*y*, and T14*y*, respectively. Similarly, the respective U and V components of the tiles are designated by reference numbers T11*uv*, T12*uv*, T13*uv*, and T14*uv*, respectively.

Figure 3J:
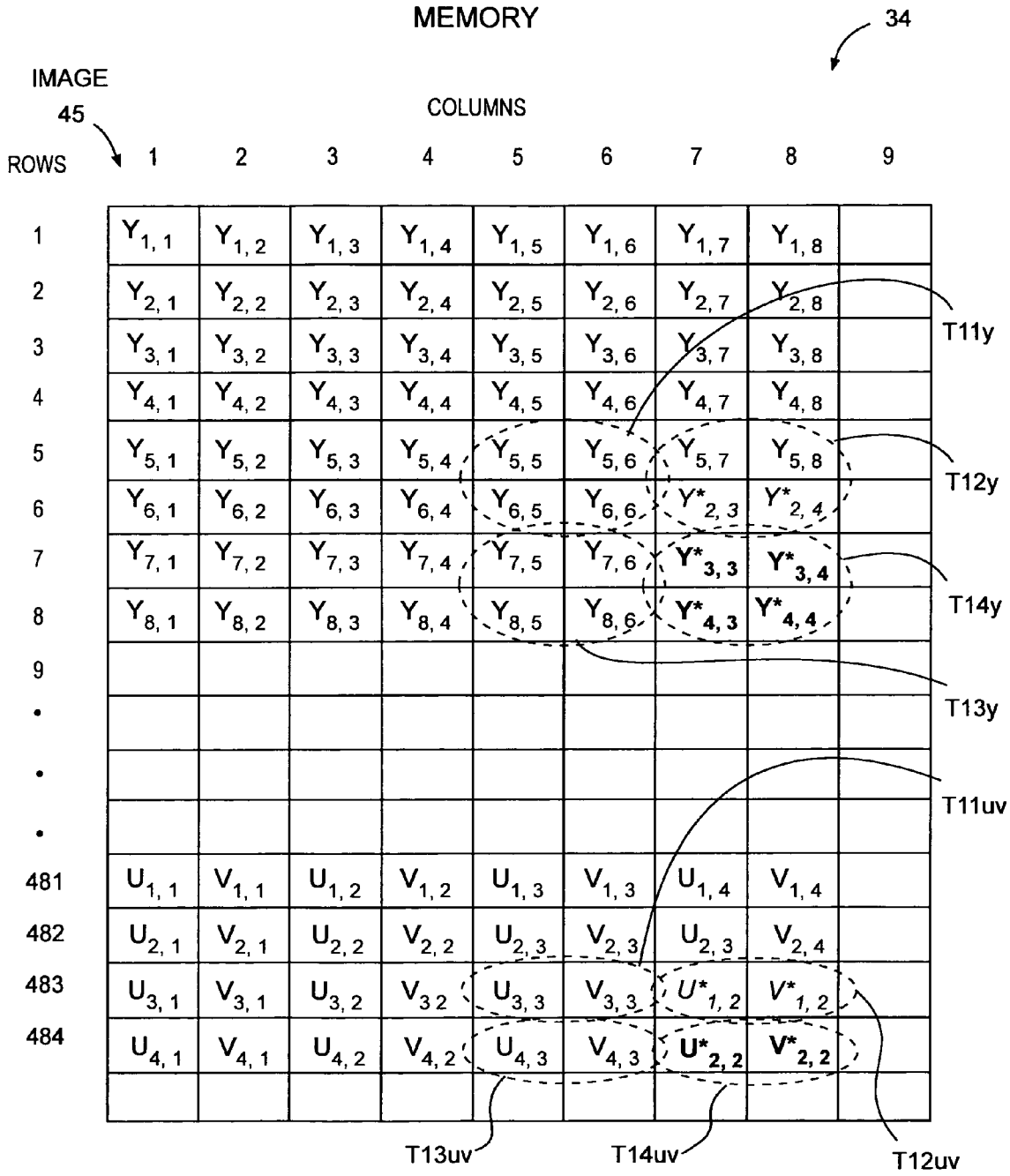
FIG. 3*j* illustrates the memory of FIG. 3*i* with the overlay window of FIG. 3*e* stored therein.

FIG. 3*j* shows the scaled overlay window 44 stored in the memory 34 over the background image 45 according to the first method for storing an overlay window. The overlay window 44 is stored in the memory at memory locations which correspond to the lower right portion of the background image 45. In particular, the tiles T7, T8, T9, and T10 of the overlay window 44 locations are stored at locations corresponding respectively to the tiles T11, T12, T13, and T14 of the background image 45.

All of the pixels in tiles T7 and T9 of the overlay window 44 are transparent. According to the first method, the pixels in tiles T7 and T9 are not stored in the memory and neither the luminance or color components of the pixels in the tiles T11 and T13 change as a result of storing the overlay window 44. Further, all of the pixels in tile T10 of the overlay window 44 are opaque. According to the first method, the pixels in tiles T10 are stored in the memory. Both the luminance or color components of the pixels in the tile T14 change as a result of storing the overlay window 44.

With reference to tile T8 of the overlay window 44, the pixels $P^*_{1,3}$ and $P^*_{1,4}$ are transparent, and the pixels $P^*_{2,3}$ and $P^*_{2,4}$ are blended. The pixels $P^*_{1,3}$ and $P^*_{1,4}$ of the overlay window 44 correspond respectively to the pixels $P_{5,7}$ and $P_{5,8}$ of the background image tile T12. The pixels $P^*_{2,3}$ and $P^*_{2,4}$ of the overlay window 44 correspond respectively to the pixels $P_{6,7}$, and $P_{6,8}$ of the background image tile T12. According to the first method, the respective luminance and chrominance components of background image pixels $P_{5,7}$, $P_{5,8}$ do not change as a result of their correspondence to the transparent pixels $P^*_{1,3}$ and $P^*_{1,4}$. The pixels $P^*_{1,3}$ and $P^*_{1,4}$, being transparent, are not stored. However, both the luminance and chrominance components of background image pixels $P_{6,7}$, and $P_{6,8}$ do change as a result of their correspondence to the blended pixels $P^*_{2,3}$ and $P^*_{2,4}$. In particular, $U^*_{1,2}$ and $V^*_{1,2}$ are stored over $U_{3,4}$, $V_{3,4}$. Because $U_{3,4}$, $V_{3,4}$ are the chrominance components of background image pixels $P_{5,7}$, $P_{5,8}$, overwriting these U, V values with the blended values $U^*_{1,2}$ and $V^*_{1,2}$ changes the color appearance of $P_{5,7}$, $P_{5,8}$.

Assuming that the background image pixels $P_{5,7}$, $P_{5,8}$ are not black, white, or gray pixels, as is typical, the background image pixels undesirably change from being colored, e.g., red, blue, green, yellow, orange, etc., to being gray. When a display frame including the background image 45 and the overlay window 44 is rendered on a display device, the back ground pixels $P_{5,7}$, $P_{5,8}$ add to the gray fringe around the periphery of darker pixels of the overlay window. The pixels $P_{5,7}$, $P_{5,8}$ are an additional, storing artifact, which is often readily noticeable, and together with the scaling artifact makes for a quite noticeable composite artifact. In other words, when storing a scaled overlay image in a single frame buffer over a background image, the pixels being defined with a reduced color resolution, such as 4:2:2, 4:2:0, or 4:1:1, a scaling artifact in one or more pixels is spread to the other pixels in the same tile by the described storing artifact mechanism.

Figure 3K:
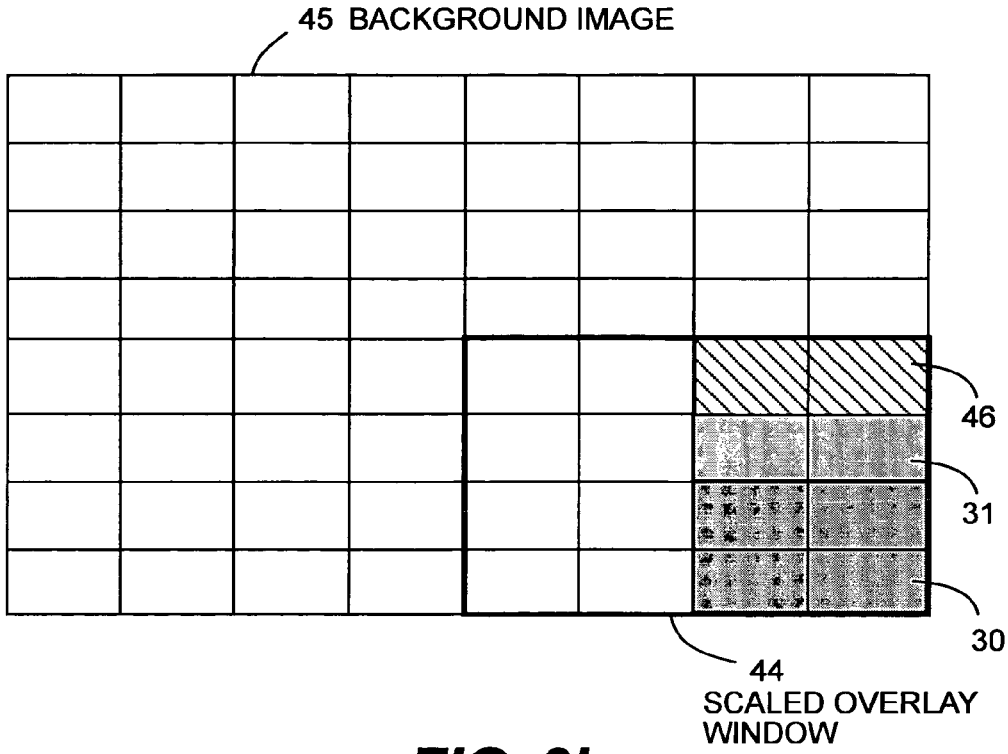
FIG. 3*k* illustrates an image rendered according to the image data stored in the memory of FIG. 3*j*.
Figure 4:
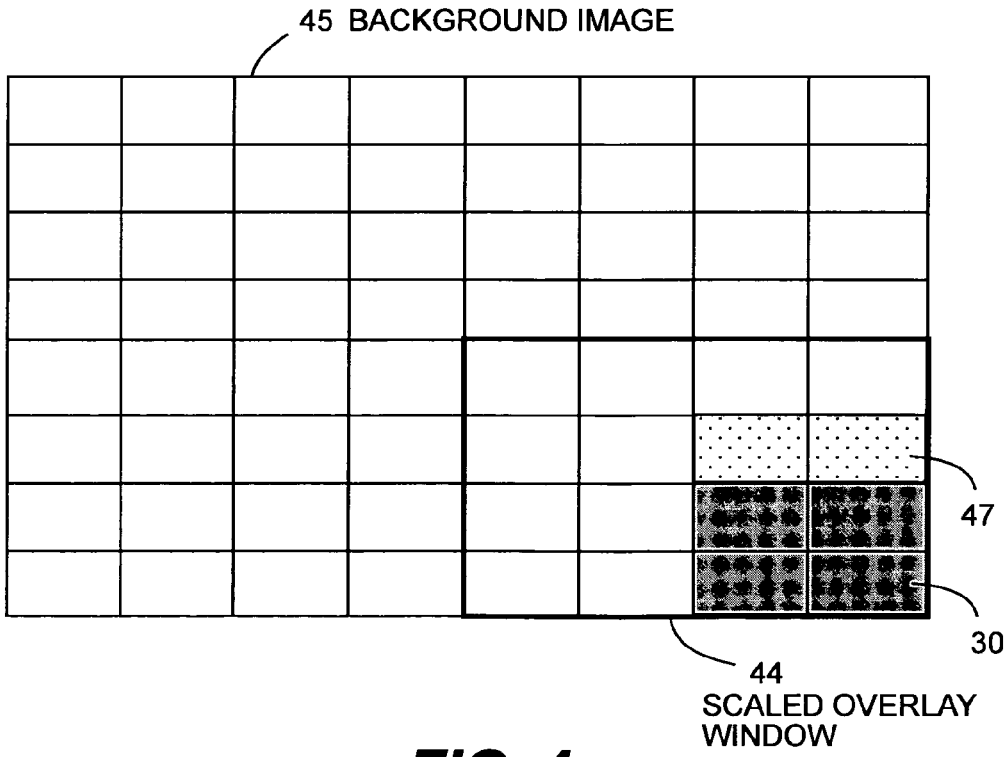
FIG. 4 illustrates an image rendered according to the image data stored in the memory of FIG. 3*i*, but having the overlay window of FIG. 3*e* stored therein according to a preferred embodiment of the invention.

FIG. 3*k* shows the overlay window 44 and background image 45 that would be displayed according to the image data stored in the memory 34 shown in FIG. 3*j*. The overlay window 44 is mapped into the lower right corner of the background image 45. Specifically, overlay window 44 is mapped into, or corresponds to, the tiles $T_{3,3}$, $T_{3,4}$, $T_{4,3}$, and $T_{4,4}$ of the background image 45. Background pixels in the background image tiles $T_{3,3}$, $T_{3,4}$, and $T_{4,4}$ and are not changed by the storing of the overlay window. The background pixels of the tile $T_{4,3}$, however, are modified by the storing of the overlay window. As mentioned, the pixels 31 ($P^*_{2,3}$ and $P^*_{2,4}$) are modified as a result of the scaling process. In addition, the color components of the pixels 46 ($P^*_{1,3}$ and $P^*_{1,4}$) are modified as a result of storing the overlay window.

Preferred embodiments are directed to methods and apparatus to eliminating the unintentional color change to the pixels the pixels 46 ($P^*_{1,3}$ and $P^*_{1,4}$) and for making the pixels 31 ($P^*_{2,3}$ and $P^*_{2,4}$) less conspicuous. In other words, preferred embodiments are directed to methods and apparatus for eliminating the storing portion of an edge artifact and for disguising a scaling portion of the edge artifact. The preferred embodiments are employed in lieu of the "first" method for storing an overlay window described above.

According to a preferred method, a scaled overlay image is received for storing in a frame buffer memory containing a previously stored background image. The background image and the overlay image are preferably stored in the YUV 4:2:0 format. Further, the overlay image is preferably scaled "on-the-fly." As the overlay window is received, the Y, U, and V components of a particular pixel are stored in the memory, provided that Y component is opaque, i.e., Y=0. However, if the Y component is transparent, i.e., Y=255, the Y, U, and V components of the pixel are discarded, thereby leaving the corresponding background image pixel intact. Further, if the pixel is neither opaque or transparent (blended), i.e., 0<Y<255 the Y component of the pixel is stored in the memory, but the U, V components of the pixel are discarded. In other words, if the pixel is blended, the U, V components of other pixels in the same tile are not changed. This eliminates the storing artifact of the first method. Further, by not storing the U, V component of the blended pixel, it disguises the scaling artifact. The blended pixel retains a blended luminance component, but loses the gray color components, taking on the color of neighboring pixels in the background image.

A significant advantage of preferred embodiments of the invention is that preferred methods and apparatus do not require background image pixels previously stored in the frame buffer memory to be read from the memory. Portions of edge artifacts are disguised and remaining portions eliminated on-the-fly. The preferred embodiments thus save memory bandwidth and conserve power over other possible methods for solving the edge artifact problem which would require reading background image pixels from memory, performing calculations using values of overlay and background pixels, and storing new calculated pixel values.

Figure 5:
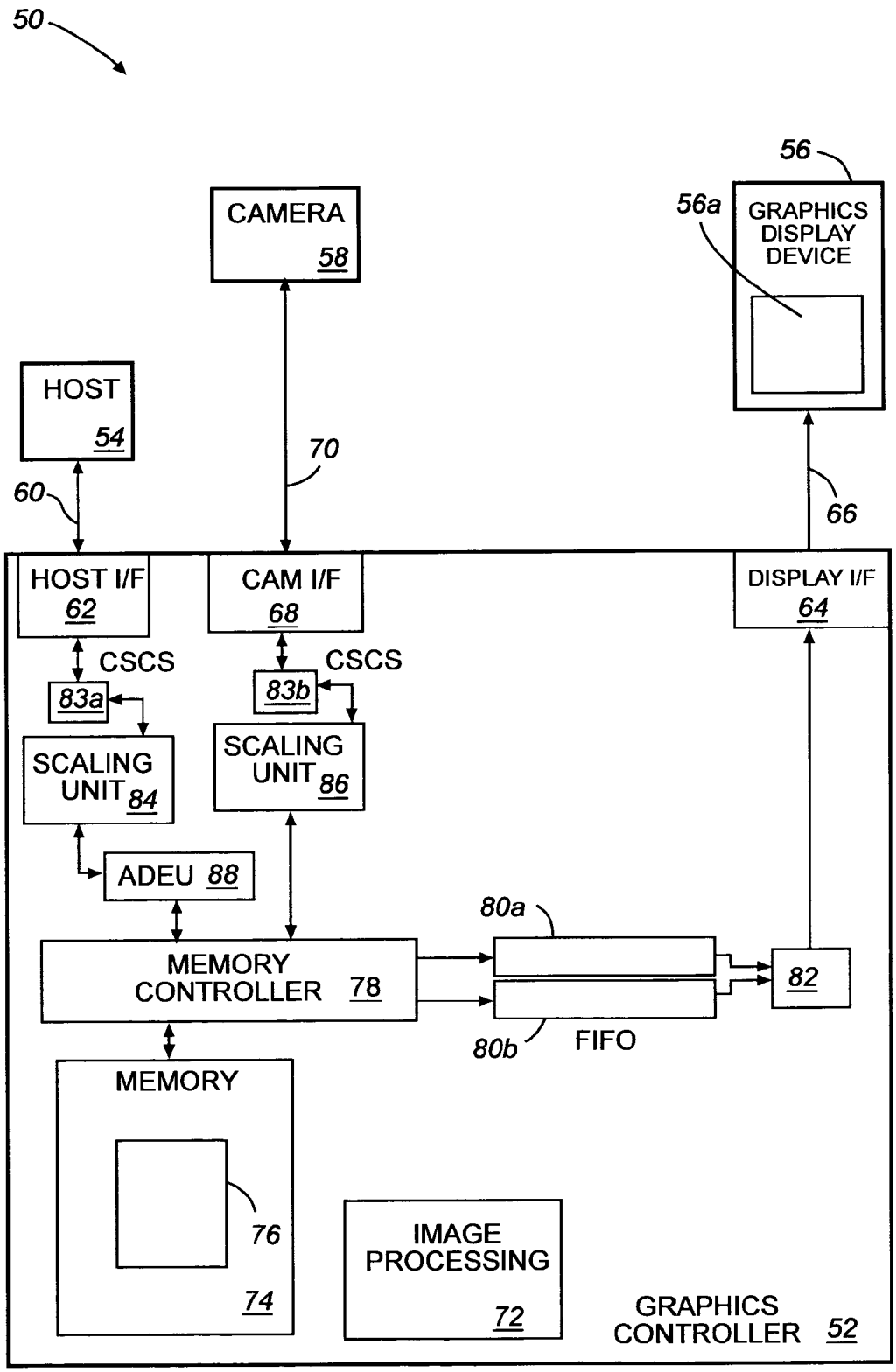
FIG. 5 is a block diagram of a graphics display system illustrating a preferred embodiment of the invention.

Preferred embodiments are also directed to integrated circuit apparatus and a graphics display systems. Turning now to FIG. 5, a graphics display system 50 is shown. The system 50 is one preferred context for the invention.

The graphics display system 50 includes a graphics controller 52 according to one preferred embodiment of the present invention. The system 50 may be any digital system or appliance. Where the system 50 is a portable digital appliance, it is typically powered by a battery (not shown). The system 50 typically includes a host 54, a graphics display device 56, and a camera module 58. The graphics controller 52 drives the display device and interfaces the host and the camera module with the display device.

The host 54 is typically a microprocessor, but may be a digital signal processor, a computer, or any other type of controlling device adapted for controlling digital circuits. The host 54 communicates with the graphics controller 52 over a bus 60 to a host interface 62 in the graphics controller.

The graphics controller 52 includes a display device interface 64 for interfacing between the graphics controller and the display device 56 over display device bus 66. LCDs are typically used as display devices in portable digital appliance, such as mobile telephones, but any device(s) capable of rendering pixel data in visually perceivable form may be employed. In a preferred embodiment, the display device 56 is a printer. The display device 56 has a display area 56*a*.

Preferably, the graphics controller 52 is a separate IC from the remaining elements of the system, that is, the graphics controller is "remote" from the host, camera, and display device.

The graphics controller 52 includes a camera interface 68 ("CAM I/F") for receiving pixel data output on data lines of a bus 70 from the camera 58.

A number of image processing operations may be performed on data provided by an image data source, such as the host or the camera. Such image processing operations may be performed by units included in an image processing block indicated generally as 72 in FIG. 6. The image processing block 72 may include, for example, a CODEC for compressing and decompressing image data.

In a preferred embodiment, the graphics controller 52 includes a memory 74 for storing frames of image data in a single frame buffer 76. In other embodiments, however, the memory 74 may be remote from the graphics controller. Data are stored in and fetched from the memory 50 under control of a memory controller 78. The memory 74 is preferably an SRAM, however, any type of memory may be employed.

Typically, the image data stored in the memory 76 are fetched and transmitted through a plurality of parallel display pipes 80 (e.g., 80*a*, 80*b*), which are preferably FIFO buffers. The output of the display pipes 80 are passed through a selecting unit 82 for selecting data from one of the pipes 80. Image data are transmitted from the selecting unit 82 through the display device interface 64 and output bus 66 to the display device 56.

In a preferred embodiment, the graphics controller 52 includes color space conversion and chroma subsampling units 83*a*, and 83*b* ("CSCS"). In addition, the graphics controller 52 preferably includes scaling units 84, 88 for scaling and cropping image data received from the host 54 and the camera 58, respectively. However, in other embodiments, a single scaling unit may be shared for data from multiple sources.

An example illustrates operation of the system 50. A background image is presented to the graphics controller 58 by the camera. The image is optionally scaled as it is received for storage in the single frame buffer 76. Alternatively, the host or another image data source provides the background image. Preferably, the image data is in a 4:4:4 format, and the image data is converted and sampled by CSCS unit 83*b* so as to be placed into the YUV 4:2:0 format, but this in not essential. In other embodiments, the image data may be provided in other color models and sampling formats.

After the background image is stored in the single frame buffer 76 via the memory controller 78, the host presents an overlay window. Preferably, the overlay window image data is in a 4:4:4 format, which is then down-scaled by the scaling unit 84, and converted and chroma subsampled by CSCS unit 83*a* so as to provide YUV 4:2:0 image data for storage in the single frame buffer 76. The scaled overlay window preferably includes at least one pixel that will produce a scaling artifact when rendered on a display device. Alternatively, another image data source provides the overlay window.

The scaled overlay window is presented to an artifact disguising and eliminating unit ("ADE unit" or "ADEU") 88. The ADE unit 88 receives pixels, examines their Y components, and directs how they are to be processed as described below.

If the Y component is opaque, i.e., Y=0, the ADE unit 88 causes the Y, U, and V components of the pixel to be stored in the single frame buffer 76 over the background image previously stored therein. If the Y component indicates the pixel is transparent, i.e., Y=255, the ADE unit 88 causes the Y, U, and V components of the pixel to be discarded, thereby leaving the corresponding background image pixel stored in the single frame buffer intact. If the ADE unit 88 detects that the pixel is neither opaque or transparent (blended), i.e., 0<Y<255, it causes the Y component of the pixel to be stored in the frame buffer 76, and the U and V components of the pixel to be discarded.

One of ordinary skill in the art will readily appreciate many ways in which the ADE unit 88 may be implemented in hardware. As one example, the ADE unit 88 may be implemented with a multiplexor and a comparator for controlling the select input of the multiplexor. As other examples, the ADE unit 88 may implemented with discrete combinational logic or via hardware definition language code.

In addition, invention is directed to a machine readable medium, such as magnetic or optical disks, hard disk drives, memory chips of any type, and other similar memory devices. Preferably, the medium embodies a program of instructions that may be executed by a machine, such as a computer system. The program of instructions may be software, firmware, hardware code, or other similar program. The program of instructions, when executed by the machine, performs a method for selectively storing all, none, or some of the components of a pixel based on the luminance value of the pixel.

As described above, the luminance parameter for determining if a pixel is opaque is preferably Y=0, and the luminance parameter for determining if a pixel is transparent is preferably, Y=255. However, the invention is not limited to these parameters. According to the invention, preferred methods may be easily adapted for use with parameters having any arbitrary value.

Further, a luminance range for determining if the Y component of a pixel is to be stored in memory, and the U and V components of the pixel to be discarded has been described as 0<Y<255. However, the invention is not limited to this range. In alternative embodiments, for example the ranges are 5<Y<250, 0<Y<240, or 10<Y<253. The range may be adjusted as desired.

The terms and expressions that have been employed in the foregoing specification are used as terms of description and not of limitation, and are not intended to exclude equivalents of the features shown and described or portions of them. The scope of the invention is defined and limited only by the claims that follow.

I claim:

1. A method for storing overlay pixels of an overlay image over background pixels of a background image, the overlay and background pixels being defined by at least a luminance component and at least one color component, wherein the at least one color component is shared between at least two pixels, the method comprising:

defining a first luminance value corresponding to a transparent overlay pixel;

defining a second luminance value corresponding to an opaque overlay pixel;

storing the luminance component and discarding the at least one color component of an overlay pixel if the luminance component differs from the first and second luminance values, so as to over-write the luminance component and to leave remaining the color component of the corresponding background pixel;

storing the luminance component and the at least one color component of an overlay pixel if the luminance component equals the second luminance value, so as to overwrite both the luminance and the at least one color component of the corresponding background pixel; and discarding the luminance component and the at least one color component of an overlay pixel if the luminance component equals the first luminance value, so as to leave remaining the luminance and the at least one color component of the corresponding background pixel;

wherein the luminance components of the overlay pixels range between a minimum and a maximum, the first luminance value being equal to one of the minimum and maximum, and the second luminance value being equal to the other one of the minimum and maximum.

2. The method of claim 1, wherein the overlay and background pixels are defined in a 4:2:2 sampling format.

3. The method of claim 1, wherein the overlay and background pixels are defined in a 4:2:0 sampling format.

4. The method of claim 1, wherein the overlay and background pixels are defined in a 4:1:1 sampling format.

5. The method of claim 1, wherein the luminance component is stored and the at least one color component is discarded if the luminance component differs from the first and second luminance values and if the luminance component is within a subset of the range between the minimum and the maximum.

6. A graphics controller for storing overlay pixels of an overlay image over background pixels of a background image, the overlay and background pixels being defined by at least a luminance component and at least one color component, wherein the at least one color component is shared between at least two pixels, comprising:

a memory; and an artifact disguising and eliminating unit including:

a comparing device to compare luminance components of the overlay pixels with a first luminance value corresponding to a transparent overlay pixel and a second luminance value corresponding to an opaque overlay pixel, and a selecting device to:

store the luminance component in the memory and discard the at least one color component of an overlay pixel if the luminance component differs from the first and second luminance values, store the luminance component and the at least one color component of an overlay pixel in the memory if the luminance component equals the second luminance value, discard the luminance component and the at least one color component of an overlay pixel if the luminance component equals the first luminance value, wherein the luminance components of the overlay pixels range between a minimum and a maximum, the first luminance value being equal to one of the minimum and maximum, and the second luminance value being equal to the other one of the minimum and maximum.

7. The graphics controller of claim 6, wherein the overlay and background pixels are defined in a 4:2:2 sampling format.

8. The graphics controller of claim 6, wherein the overlay and background pixels are defined in a 4:2:0 sampling format.

9. The graphics controller of claim 6, wherein the overlay and background pixels are defined in a 4:1:1 sampling format.

10. The graphics controller of claim 6, wherein the luminance component is stored and the at least one color component is discarded if the luminance component differs from the first and second luminance values and if the luminance component is within a subset of the range between the minimum and the maximum.

11. A graphics display system for storing overlay pixels of an overlay image over background pixels of a background image, the overlay and background pixels being defined by at least a luminance component and at least one color component, wherein the at least one color component is shared between at least two pixels, comprising:

a display device;

at least one image data source;

a frame buffer memory; and an artifact disguising and eliminating unit including:

a comparing device to compare luminance components of the overlay pixels with a first luminance value corresponding to a transparent overlay pixel and a second luminance value corresponding to an opaque overlay pixel, and a selecting device to:

store the luminance component in the memory and discard the at least one color component of an overlay pixel if the luminance component differs from the first and second luminance values, store the luminance component and the at least one color component of an overlay pixel in the memory if the luminance component equals the second luminance value, discard the luminance component and the at least one color component of an overlay pixel if the luminance component equals the first luminance value, wherein the luminance components of the overlay pixels range between a minimum and a maximum, the first luminance value being equal to one of the minimum and maximum, and the second luminance value being equal to the other one of the minimum and maximum.

12. The graphics display system of claim 11, wherein the overlay and background pixels are defined in a 4:2:2 sampling format.

13. The graphics display system of claim 11, wherein the overlay and background pixels are defined in a 4:2:0 sampling format.

14. The graphics display system of claim 11, wherein the overlay and background pixels are defined in a 4:1:1 sampling format.

15. The graphics display system of claim 11, wherein the luminance component is stored and the at least one color component is discarded if the luminance component differs from the first and second luminance values and if the luminance component is within a subset of the range between the minimum and the maximum.

* * * * *